US006800151B1

(12) United States Patent
Shima

(10) Patent No.: US 6,800,151 B1
(45) Date of Patent: Oct. 5, 2004

(54) METHOD OF MODIFYING PROPERTIES OF HIGH-STRENGTH, HIGH-CONDUCTIVITY CU-AG ALLOY PLATE, AND METHOD OF PRODUCING HIGH-STRENGTH, HIGH CONDUCTIVITY CU-AG ALLOY PLATE

(75) Inventor: Kunihiro Shima, Kanagawa (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 188 days.

(21) Appl. No.: 09/926,758

(22) PCT Filed: Apr. 6, 2001

(86) PCT No.: PCT/JP01/02986

§ 371 (c)(1),
(2), (4) Date: Dec. 13, 2001

(87) PCT Pub. No.: WO01/79577

PCT Pub. Date: Oct. 25, 2001

(30) Foreign Application Priority Data

Apr. 17, 2000 (JP) ..... 2000-114756

(51) Int. Cl.[7] ..... C23F 1/08

(52) U.S. Cl. ..... 148/554; 148/432; 148/679; 148/684; 148/685

(58) Field of Search ..... 148/554, 679, 148/684, 685, 432

(56) References Cited

U.S. PATENT DOCUMENTS 2,353,254 A * 7/1944 McCandless ..... 220/89.2
2,567,560 A * 9/1951 Hodge ..... 148/685
5,322,574 A * 6/1994 Sakai et al. ..... 148/538

FOREIGN PATENT DOCUMENTS

| | | | |
|---|---|---|---|
| EP | 589609 | | 3/1994 |
| JP | 56-266 | * | 1/1981 |
| JP | 56-44759 | * | 4/1981 |
| JP | A-6-73515 | | 3/1994 |

* cited by examiner

*Primary Examiner*—John J. Zimmerman
(74) *Attorney, Agent, or Firm*—Rothwell, Figg, Ernst & Manbeck, P.C.

(57) ABSTRACT

The present invention provides a method of modifying conductivity- and strength-related properties of a Cu—Ag alloy plate produced by predetermined annealing and cold rolling, composed of 4 to 32% by atom of Ag and Cu accounting for the balance, wherein the plate rolled at any reduction ratio is heated at different temperature levels, and strength and conductivity of the plate after the annealing are measured for each annealing temperature so as to establish the conductivity-annealing temperature curve and strength-annealing temperature curve as the correlations between annealing temperature and strength and between annealing temperature and conductivity, then, an optimum annealing temperature required to provide a desired conductivity or strength is determined by extrapolating the above-described conductivity-annealing temperature curve or strength-annealing temperature curve at the desired conductivity or strength, and the plate prepared at any reduction ratio is annealed at the optimum annealing temperature.

6 Claims, 5 Drawing Sheets

(a)

(b)

METHOD OF MODIFYING PROPERTIES OF HIGH-STRENGTH, HIGH-CONDUCTIVITY CU-AG ALLOY PLATE, AND METHOD OF PRODUCING HIGH-STRENGTH, HIGH CONDUCTIVITY CU-AG ALLOY PLATE

TECHNICAL FIELD

The present invention relates to a method of modifying strength- and conductivity-related properties of high-strength, high-conductivity Cu—Ag alloy plate, and method of producing high-strength, high-conductivity Cu—Ag alloy plate.

BACKGROUND ART

Development of high-strength, high-conductivity materials has been urged for, e.g., IC lead frames and conductive materials of magnet for superstrong magnetic field. These electroconductive materials are required to have various properties, e.g., sufficient strength even under a high electromagnetic force produced by the magnetic field of high strength in which it is placed, and generate less heat due to the resistance even in the presence of large current. As the electric/electronic industries advances recently, these trends become prominent.

A Cu—Ag alloy is commonly used as an electroconductive material. However, it is difficult for the conventional Cu—Ag alloy to have sufficiently high strength and conductivity simultaneously, because ensuring of the conductivity and ensuring of the strength are not compatible with each other: increasing Ag content to improve strength decreases conductivity, and increasing Cu content to secure sufficient conductivity decreases strength. Therefore, the conventional alloy must keep Ag content at a very low level of about 0.3 to 0.5% by atom to secure conductivity, resulting in sacrifice of the strength.

Among Cu—Ag alloy materials recently developed in this context, a high-strength, high-conductivity Cu—Ag alloy is produced by a method disclosed in Japanese Patent No. 2,104,108. The Cu—Ag alloy is produced through subjecting the alloy ingot containing Ag at 4 to 32% by atom, and Cu as the balance to casting, rapidly quenching, cold rolling, and annealing at 300 to 500° C. for 0.5 to 5 hours in a vacuum or inert atmosphere, then repeating the cold rolling and annealing steps at least twice. Since the Cu—Ag alloy has a crystal structure with the Cu/Ag eutectic crystal phase distributed uniformly and finely, and with the primary Cu and eutectic crystal phases stretched in filament, and it has an advantage of very high strength while keeping high conductivity. It is assumed to be a promising material for the above purposes. This method employing cold rolling as the cold treatment step has been used to produce the high-strength, high-conductivity Cu—Ag alloy plate.

The above-described high-strength, high-conductivity Cu—Ag alloy material is provided with the properties of high strength and conductivity by undergoing cold rolling and annealing twice or more for each treatment. It is normally treated further by finish rolling to have a desired thickness in the last stage before it becomes the final commercial product.

Its properties of conductivity and strength depend on processing history. More specifically, its properties, depends on reduction ratio at each of the cold rolling steps effected twice or more before finish rolling and reduction ratio at the finish rolling step. Therefore, its properties are defined uniquely processing history. Usually, requirement of the properties for the commercial product varies to some extent, depending on its purposes; strength taking precedence over conductivity for a product, and conductivity taking precedence over strength for another product. It is therefore necessary, when two or more types of products having different property requirements are to be produced, to treat the work at different reduction ratio for each product type.

Changing reduction ratio for different property requirements depending on production requirement is not desirable viewed from production efficiency. Since the material is produced by undergoing a relatively large number of production steps, such as undergoing annealing and cold rolling twice or more for each, variation of reduction ratio for each product provides large influence on the production efficiency. Moreover, the special materials, like the high-strength, high-conductivity Cu—Ag alloy plate of the present invention, are not necessarily produced massively. When a manufacturer runs the production in low production efficiency because of requirement of diversified product types produced in a small quantity, the manufacturer inevitably increases the product prices.

The present invention is developed, in the context described above. It is an object of the present invention to provide a method of modifying properties for the high-strength, high-conductivity Cu—Ag alloy plate produced by the above-described steps, which allows to produce the product with two or more required properties at any reduction ratio, i.e., without changing processing history or reduction ratio for each property requirement. It is another object of the present invention to provide a method of producing high-strength, high-conductivity Cu—Ag alloy plate, based on the same method of modifying properties.

DISCLOSURE OF THE INVENTION

The inventor of the present invention found, after having extensively studied to solve the above problems, that annealing of the finish-rolled plate changes its properties with respect to conductivity and strength. The inventor further found that the changed properties as a result of annealing show a certain tendency that increasing annealing temperature decreases strength and increases conductivity, irrespective of reduction ratio. The inventor investigated the trends of the properties changed by the annealing for the plates prepared at varying reduction ratios, and considered that the desired product could be produced by annealing the plate produced at a certain reduction ratio at varying temperature levels to modify its properties, reaching the present invention.

The present invention provides a method of modifying conductivity- or strength-related properties of a Cu—Ag alloy plate, prepared by the steps of:

(a) casting and rapidly quenching an alloy ingot composed of 4 to 32% by atom of Ag and Cu accounting for the balance, (b) cold rolling, then annealing the ingot at 300 to 500° C. for 0.5 to 5 hours under a vacuum, or in an inert gas, reducing gas or mixture of inert and reducing gas atmosphere, (c) repeating the above step (b) once or more, and (d) cold rolling as the finish rolling to provide a desired thickness of the plate, wherein the plate rolled at any reduction ratio in the steps (b) to (d) is heated at different temperature levels, and strength and conductivity of the plate after the annealing are measured for each annealing temperature so as to establish the conductivity-annealing temperature curve and strength-annealing temperature curve as the correlations between annealing temperature and strength and between annealing temperature and conductivity, then, an optimum annealing temperature required to provide a desired conductivity or strength is determined by extrapolating the above-described conductivity-annealing temperature curve or strength-annealing temperature curve at the desired conductivity or strength, and the plate prepared at any reduction ratio is annealed at the optimum annealing temperature.

The method of the present invention for modifying the properties of the Cu—Ag alloy plate is described more specifically. FIGS. 1(*a*) and 1(*b*) show the properties of the high-strength, high-conductivity Cu—Ag alloy plate, prepared at a certain reduction ratio and annealing temperature, changing with annealing temperature; FIG. 1(*a*) for conductivity and FIG. 1(*b*) for strength, both of the annealed alloy plate. Strictly speaking, shape of each curve is considered to vary with the treatment history the plate has undergone. However, there is a general trend that increasing annealing temperature decreases strength and increases conductivity, as shown in FIG. 1.

The method of the present invention allows to find the optimum annealing temperature by obtaining the conductivity-annealing temperature curve or strength-annealing temperature curve for the plate prepared at any reduction ratio, and on the basis of the both curves, extrapolating the both curves at a desired conductivity or strength on the ordinate. Which curve is used as the standard to determine the optimum annealing temperature depends on the required properties of the product. For example, for the product with conductivity as the priority property, it is preferable to determine the optimum annealing temperature using the conductivity-annealing temperature curve and then to consider strength which would result when the plate is annealed at the above temperature using the strength-annealing temperature curve. Recommended annealing time for establishing the correlation is about 0.5 to 1.0 hour, in consideration of efficiency of drawing the curve. It is also preferable that the finish-rolled plate is annealed for property modification at the optimum annealing temperature determined by the above procedure for the same time period as that used for establishing the correlation, in order to avoid the error with respect to the curve.

To describe the procedure to determine the optimum annealing temperature more specifically, consider that the curves shown in FIGS. 1(*a*) and 1(*b*) are established for a plate prepared at a certain reduction ratio. For example, in the case where the desired conductivity is "Ca", FIG. 1(*a*) gives the optimum annealing temperature "Ta" to give a desired conductivity "Ca".

Next, the strength-annealing temperature curve, shown in FIG. 1(*a*), can be used to verify in the case of the plate heated at the temperature of Ta whether the optimum temperature "Ta" for the desired conductivity gives a desired strength by evaluating whether the strength "Ta" is within an acceptable range.

The optimum annealing temperature for the case where strength is given priority over conductivity can be determined in a similar manner, using the strength-annealing temperature curve first.

Hardness or tensile strength (stress) may be used as the standard parameter for strength in the above procedure. However, tensile strength is more important for IC lead frames and magnet conductors working in a magnetic field of superhigh strength as the major prospective applicable areas for the high-strength, high-conductivity Cu—Ag alloy plate of the present invention. It is therefore preferable to use tensile strength to prepare the strength-annealing temperature curve.

Thus, even when two or more types of products of different properties are produced for one alloy plate type prepared under any processing history, such products can be easily produced, according to the present invention, by obtaining a characteristic curve for the case of the plate being preannealed in advance, then determining an optimum annealing temperature, based on the characteristic curve, for characteristic requirement of each product, and annealing each type at the optimum temperature.

The inventor of the present invention yet further found, after having investigated the changed properties by the annealing for an alloy plate prepared under two or more different processing history, that annealing of the plate at temperature in a constant range gives the product of well-balanced strength and conductivity, reaching the method of producing a high-strength, high-conductivity Cu—Ag alloy plate by annealing the finish-rolled plate at temperature in a given range.

More specifically, the second invention provides a method of producing a Cu—Ag alloy plate, comprising the steps of:

(a) casting and rapidly quenching an alloy ingot composed of 4 to 32% by atom of Ag and Cu accounting for the balance, (b) cold rolling, and annealing the ingot at 300 to 500° C. for 0.5 to 5 hours under a vacuum, or in an inert gas, reducing gas or mixed inert and reducing gas atmosphere, (c) repeating the above step (b) once or more, (d) cold rolling as the finish rolling to provide a desired thickness of the plate, and (e) annealing the plate at 150 to 400° C. for 0.5 to 5 hours.

In the above-described method of producing a Cu—Ag alloy plate, the steps (a) to (c) are similar to those for the conventional method of producing a high-strength, high conductivity Cu—Ag alloy plate, described earlier. The method of the present invention involves the additional annealing step for the finish-rolled plate at 150 to 400° C. for 0.5 to 5 hours.

It is necessary to anneal the finish-rolled plate at temperature in a range of 150 to 400° C.: a longer annealing time will be required to have the required properties, because strength and conductivity of the plate will change only slowly at 150° C. or less, whereas strength will decrease to an unpractical level at 400° C. or more because of softening occurring as a result of the recrystallization, while conductivity is increased, so that products not suitable for actual use will be made. The plate can be adequately annealed for 0.5 to 5 hours: it may be difficult to sufficiently change the properties in an annealing time of 0.5 hour or less, and the further effects may no longer expected when the plate is annealed for 5 hours or more. Therefore, annealing time of 0.5 to 5 hours is adequate in consideration of production efficiency.

The annealing is effected under a vacuum, or in an inert gas, reducing gas or mixed inert and reducing gas atmosphere, in order to prevent oxidation of the material.

The annealing is preferably effected at 150 to 200° C., when the balance between conductivity and strength is of special concern, because the plate tends to decrease in strength relatively significantly when annealed at 200° C. or more.

BEST MODE FOR CARRYING OUT THE INVENTION

Preferable embodiments of the present invention will be described with reference to the drawings.

First Embodiment

An alloy of Cu(76% by atom)—Ag(24% by atom) was molten in a vacuum smelting furnace, cast and rapidly quenched into the ingot, 50 mm thick and 200 mm wide. The ingot was then annealed and hot-rolled at 450° C., and formed by pressing and facing into the 21 mm thick plate.

The formed plate was cold-rolled and annealed, each twice, to have a thickness of 10.5 mm, wherein the annealing was effected at 450° C. for 1 hour in a flow of nitrogen/hydrogen/steam mixture. It was further cold-rolled to have a thickness of 6.3 mm, annealed at 400° C. for 1 hour in a flow of nitrogen/hydrogen/steam mixture, and cold-rolled to have a thickness of 1.5 mm. Then, it was adjusted to have a given width, and finished by cold rolling to have a thickness of 0.4 mm.

The finish-rolled plate was cut into test pieces for property evaluation, and they were heated at 100 to 500° C. in a flow of nitrogen gas. The test pieces were heated for two different time periods, 0.5 and 1 hour, and they heated at each temperature level and time period were measured for their conductivity and tensile strength in two directions, 0° and 90° to the rolling direction.

Figure 1:
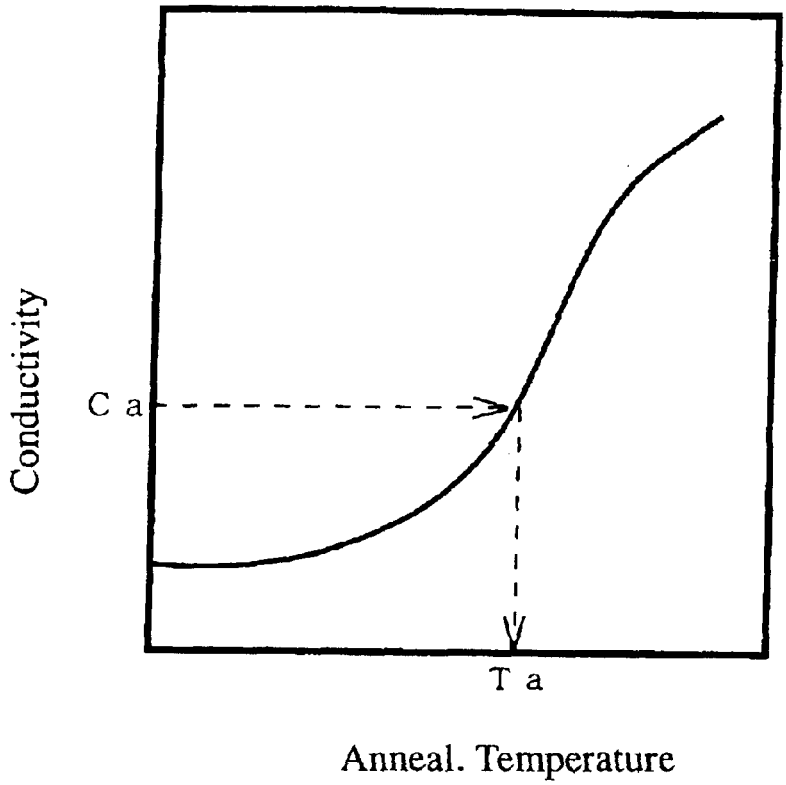
FIG. 1 schematically illustrates strength and conductivity of a finish-rolled high-strength, high-conductivity Cu—Ag alloy plate, changing during the annealing step.
Figure 1:
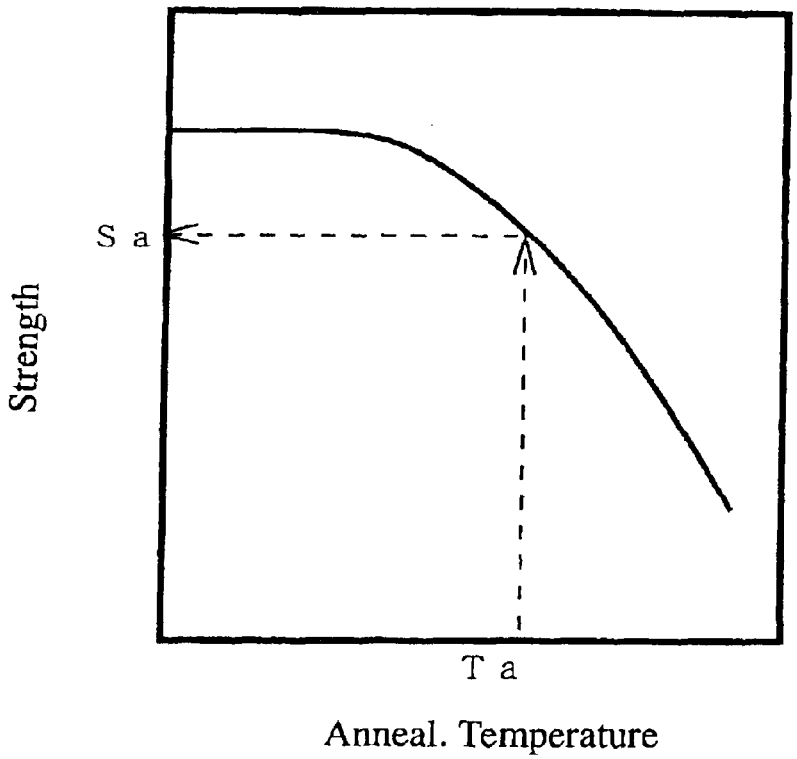
Figure 2:
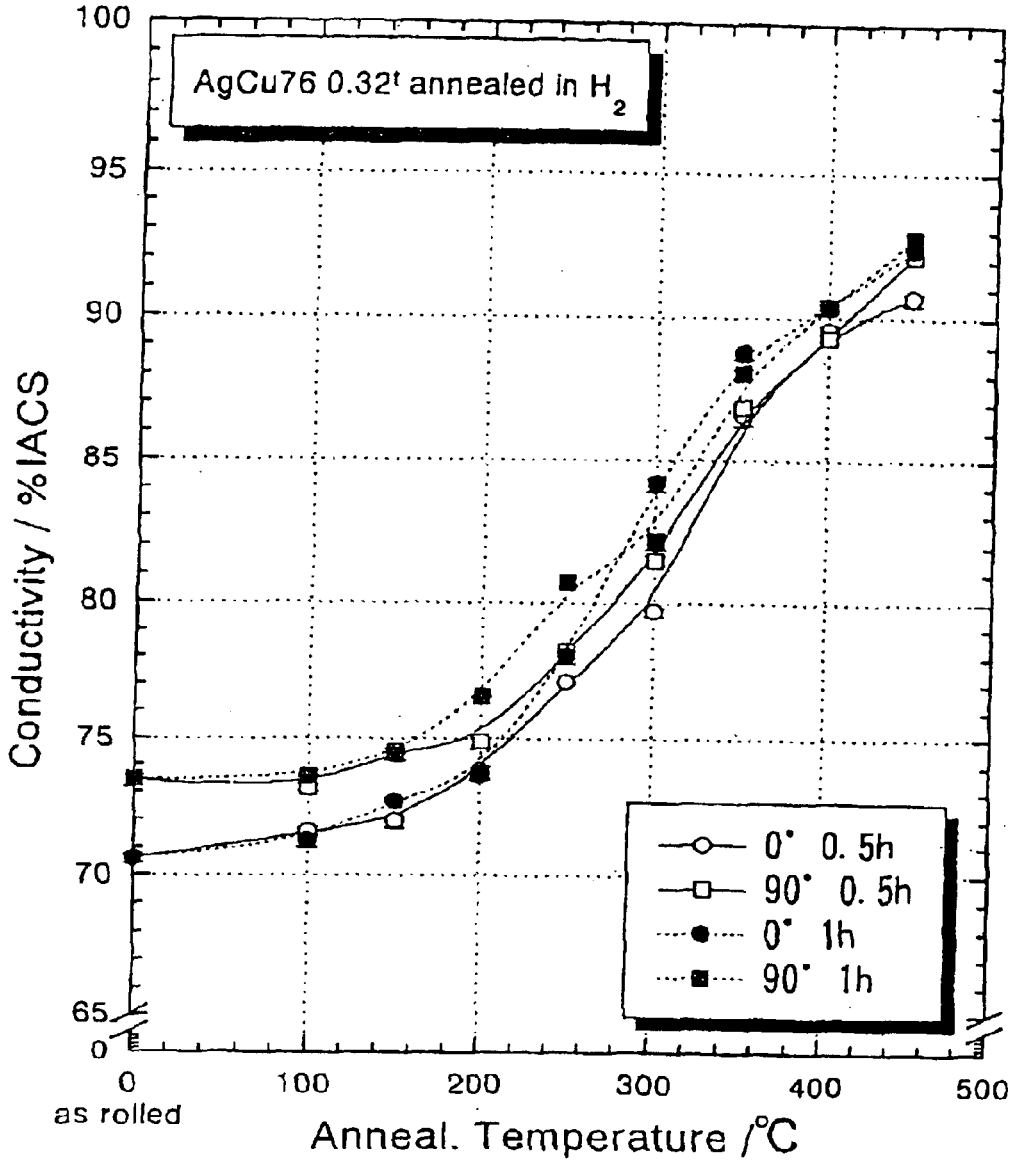
FIG. 2 shows the relationship between conductivity and annealing temperature for the finish-rolled Cu(76% by atom)—Ag(24% by atom) plate, prepared in a first embodiment.
Figure 3:
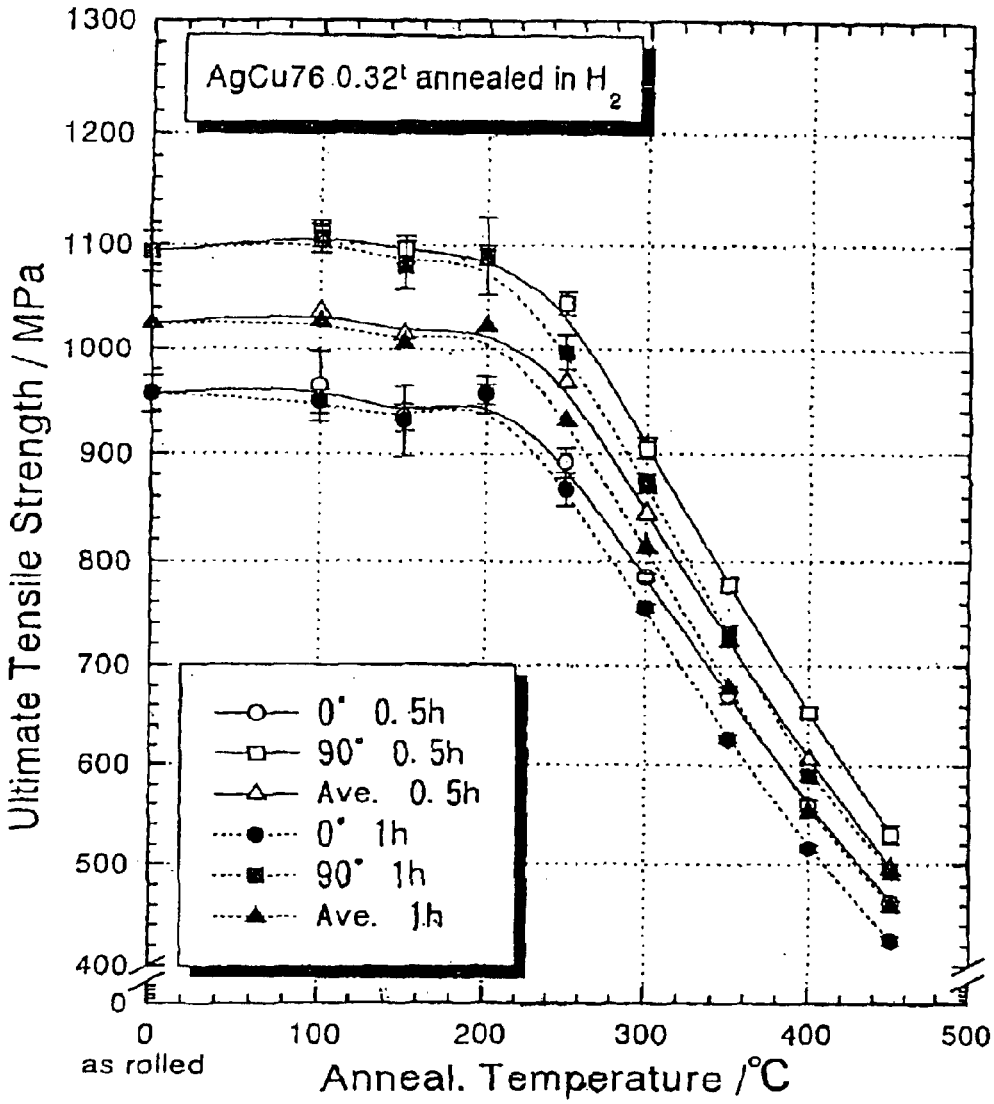
FIG. 3 shows the relationship between tensile strength and annealing temperature for the finish-rolled Cu(76% by atom)—Ag(24% by atom) plate, prepared in the first embodiment.

FIG. 2 shows the results, the relationship between conductivity and annealing temperature for the finish-rolled plate, and FIG. 3 shows the relationship between tensile strength and annealing temperature. As shown in FIGS. 2 and 3, the observed results also indicate that tensile strength decreases and conductivity increases as annealing temperature increases with this electroconductive alloy.

The optimum annealing temperature was determined to secure the conductivity-based properties (i.e., corresponding to Class $III_{HH}$, conductivity: 80% IACS or more) using the curve, shown in FIG. 3, established with the test piece annealed for 0.5 hour and measured for its conductivity in the direction of 0° in the rolling direction. The optimum temperature corresponding to the 80% IACS level was 270° C. The alloy which had not been annealed was treated at 270° C. for 0.5 hour. It was found to have a conductivity almost equivalent to that predicted using the curve, and a tensile strength of approximately 800 MPa.

It is therefore considered that the alloy plate prepared by the above-described production steps can be modified to meet various property requirements when annealed at the optimum temperature determined for a given conductivity or tensile strength, thus dispensing with necessity to produce the plates of different properties by different steps.

Second Embodiment

In this embodiment, an alloy plate having the same composition as that for the first embodiment, namely 76% by atom of Cu and 24% by atom of Ag, was prepared at a different reduction ratio of finish rolling. The finish-rolled plate was annealed at varying temperature levels, to draw the tensile strength-annealing temperature and conductivity annealing temperature curves.

The plate was annealed at the same temperature and rolled at the same reduction ratio as those for the first embodiment in the production steps up to the finish rolling. However, it was rolled at a different reduction ratio in the finish rolling to have a final thickness of 0.8 mm, and annealed at varying temperature levels.

Figure 4:
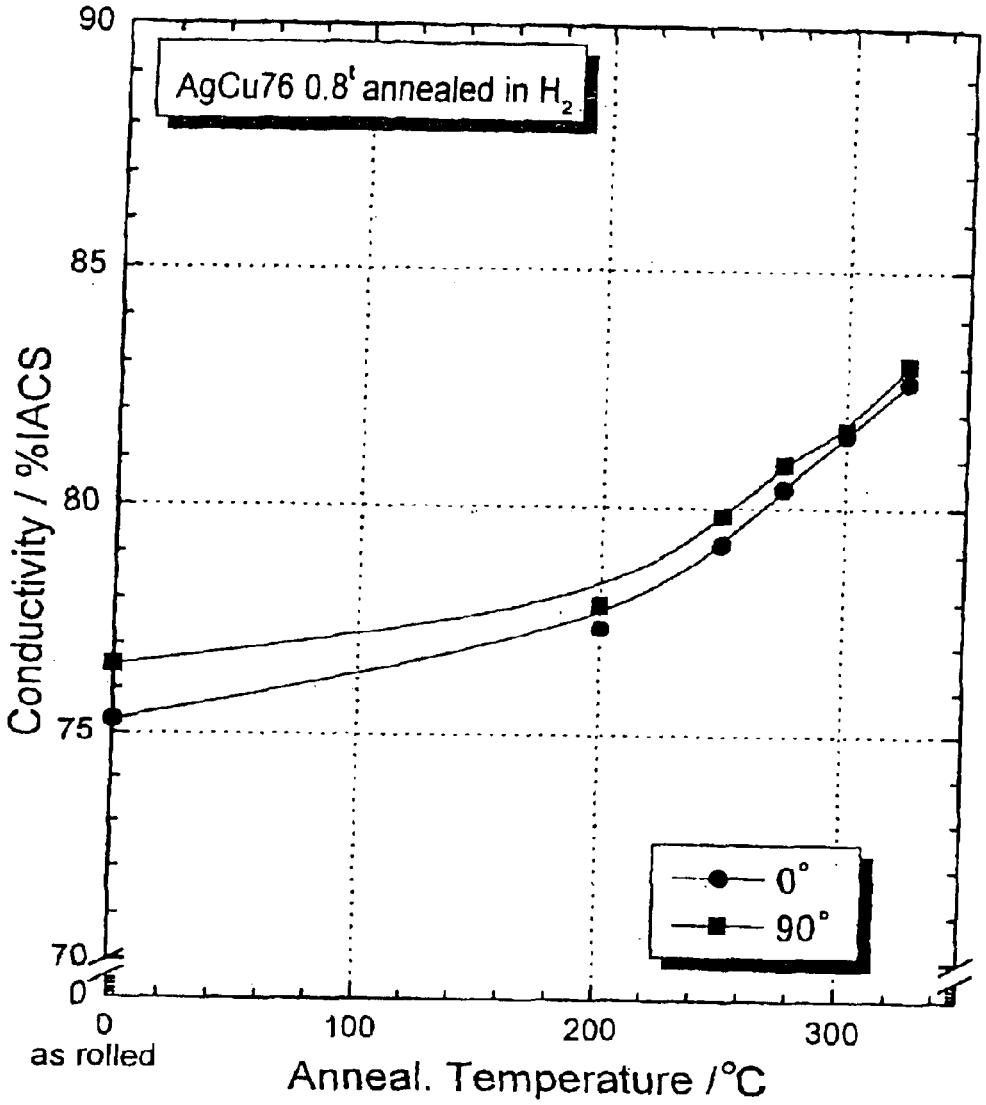
FIG. 4 shows the relationship between conductivity and annealing temperature for the finish-rolled Cu(76% by atom)—Ag(24% by atom) plate, prepared in a second embodiment.
Figure 5:
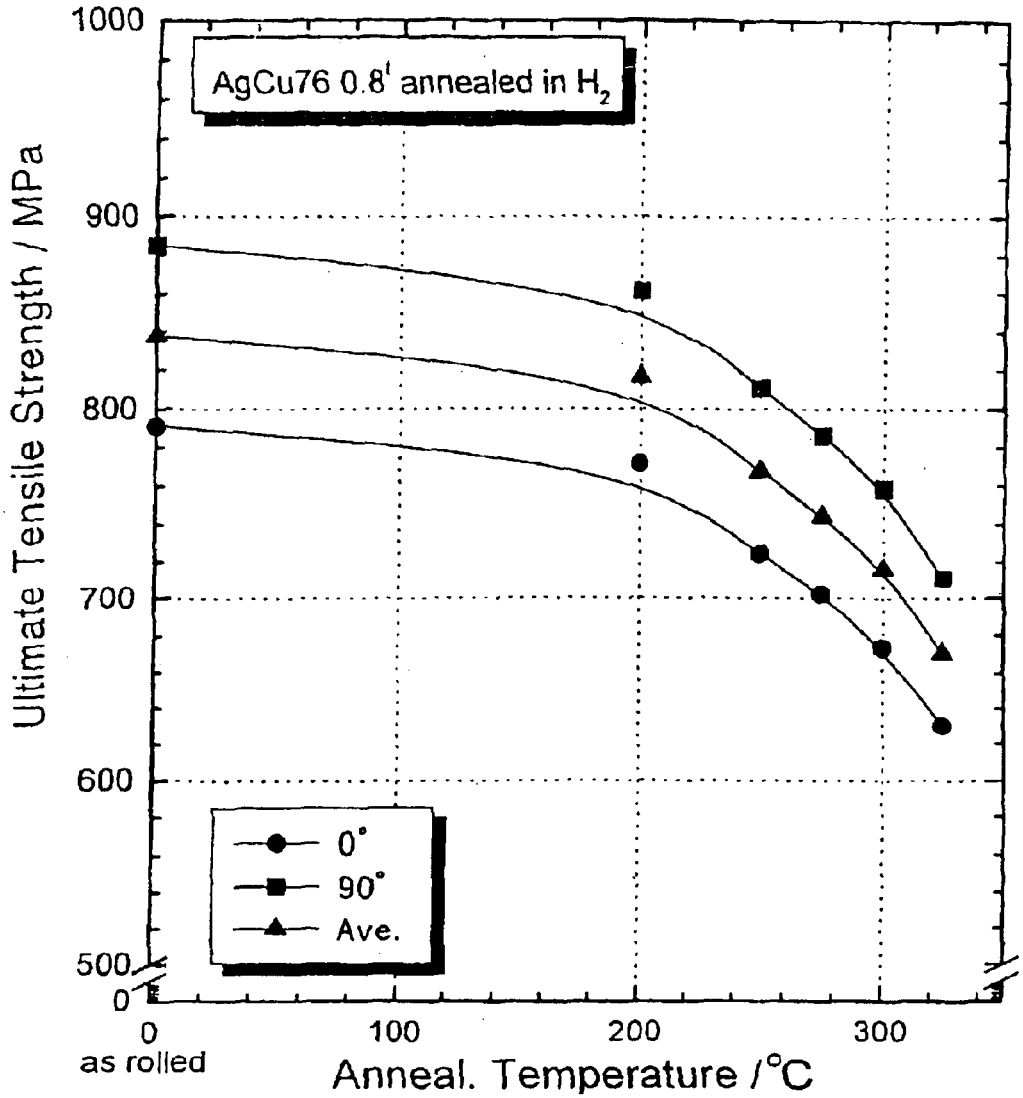
FIG. 5 shows the relationship between tensile strength and annealing temperature for the finish-rolled Cu(76% by atom)—Ag(24% by atom) plate, prepared in the second embodiment.

FIGS. 4 and 5 show the conductivity-annealing temperature and tensile strength-annealing temperature curves, respectively, for the alloy plate prepared in this embodiment. These Figures also indicate that tensile strength decreases and conductivity increases as annealing temperature increases. The alloy which had been finish-rolled but not annealed was treated at the optimum temperature determined for the required conductivity using these Figures. It was also found to have a conductivity almost comparable with that predicted using the curve, as was the case with the first embodiment.

Industrial Applicability

As described above, even when two or more types of high-strength, high-conductivity Cu—Ag alloy plates of different properties are to be produced for one alloy plate type prepared under any processing history, the present invention can easily produce such products by annealing each type at the optimum temperature determined to give the required properties based on the pre-established characteristic curves. This allows to flexibly cope with the requirements for production of diversified products in small quantity, improving production efficiency and possibly reducing the product price.

What is claimed is:

1. A method of producing a high-strength, high-conductivity Cu—Ag alloy plate, comprising the steps of:

(a) casting and rapidly quenching an alloy ingot composed of 4 to 32 atomic % of Ag, with Cu accounting for the balance, (b) thereafter cold rolling, and then annealing the ingot at 300 to 500° C. for 0.5 to 5 hours under a vacuum, or in an inert gas, reducing gas or mixture of inert and reducing gases atmosphere, (c) repeating the above step (b) at least once, (d) thereafter cold rolling as the finish rolling to a desired thickness of the plate, and (e) thereafter annealing the plate at 150 to 200° C. for 0.5 to 5 hours.

2. A method of producing a high-strength, high-conductivity Cu—Ag alloy plate according to claim 1, wherein the cold rolling of step (b) is conducted with a workability of 40–76%.

3. A method for determining the optimum temperature for annealing a Cu—Ag alloy plate so as to produce an alloy plate with a desired strength and conductivity, comprising the steps of:

(a) casting and rapidly quenching an ingot composed of 4 to 32 atomic % of Ag, with Cu accounting for the balance, (b) thereafter cold rolling and then annealing the ingot at 300 to 500° C. for 0.5 to 5 hours under a vacuum, or in an inert gas, reducing gas or mixture of inert and reducing gases atmosphere, (c) repeating step (b) at least once, (d) thereafter cold rolling as the finish rolling to achieve a desired plate thickness, (e) heating at least one first sample of the rolled Cu—Ag alloy plate of step (d) to at least one first temperature and measuring the resulting strength and conductivity of the first sample, (f) heating at least one second sample of the rolled Cu—Ag alloy plate of step (d) to at least one second temperature and measuring the resulting strength and conductivity of the second sample, (g) establishing a strength-temperature curve and a conductivity-temperature curve from the data collected in steps (e) and (f), and (h) using the strength-temperature curve and conductivity-temperature curve to determine the optimum annealing temperature required to provide a desired strength and conductivity.

4. The method of claim 2, wherein additional samples of rolled Cu—Ag alloy plate of step (d) are heated to a plurality of temperatures for at least one first time and measured for resulting strength and conductivity, with this data used to establish the strength-temperature and conductivity-temperature curves, thereby improving the accuracy of the curves and improving the accuracy of the determination of the optimum annealing temperature.

5. The method of claim 3, wherein additional samples of rolled Cu—Ag alloy plate of step (d) are heated to a plurality of temperatures for a plurality of times and measured for resulting strength and conductivity, with this data used to establish the strength-temperature and conductivity-temperature curves, thereby improving the accuracy of the curves and improving the accuracy of the determination of the optimum annealing temperature.

6. The method of claim 2, wherein the strength and conductivity of the samples are measured 0° to the rolling direction and 90° to the rolling direction.

* * * * *